US005909760A

United States Patent [19]

Tsai

[11] Patent Number: 5,909,760

[45] Date of Patent: Jun. 8, 1999

[54] STEPLESS EXPANDABLE ROD

[76] Inventor: James Tsai, 103, Ta-Ming 1 Rd., Tung Pao Tsun, Tan Tzu Hsiang, Taichung Hsien, Taiwan

[21] Appl. No.: 09/076,780

[22] Filed: May 13, 1998

[51] Int. Cl.[6] ..... A47B 95/02

[52] U.S. Cl. ..... 16/115; 190/39; 190/115

[58] Field of Search ..... 16/115; 280/655, 280/655.1; 190/39, 115; 403/365, 372, 109.7

[56] References Cited

U.S. PATENT DOCUMENTS

| | | | |
|---|---|---|---|
| 5,500,410 | 3/1996 | Ho | 16/115 |
| 5,613,273 | 3/1997 | Tsai | 16/115 |
| 5,628,088 | 5/1997 | Chen | 16/115 |
| 5,636,410 | 6/1997 | Chou | 16/115 |
| 5,704,725 | 1/1998 | Horing | 403/109 |
| 5,713,440 | 2/1998 | Chen | 190/115 X |
| 5,729,866 | 3/1998 | Chg | 16/115 |

*Primary Examiner*—Milton Nelson, Jr.
*Assistant Examiner*—Brian H. Buck
*Attorney, Agent, or Firm*—Browdy and Neimark

[57] ABSTRACT

A stepless expandable rod is composed of an outer tube provided therein with an insertion slot and a tube compartment, an insertion strip located in the insertion slot and provided with a plurality of retaining holes, an inner tube expandable received in the tube compartment of said outer tube, a connection rod received in the inner tube and capable of an axial displacement, and a retaining member located at the bottom end of the inner tube and provided with a retaining projection capable of being actuated by the connection rod to extract to engage one of the retaining holes of the insertion strip so as to retain the bottom end of the inner tube at a position in the outer tube at the time when the inner tube is extracted from the top end of the outer tube.

3 Claims, 3 Drawing Sheets

STEPLESS EXPANDABLE ROD

FIELD OF THE INVENTION

The present invention relates generally to a pull rod for luggage, and more particularly to a stepless and expandable rod.

BACKGROUND OF THE INVENTION

As shown in FIG. 1, a stepless expandable rod 10 of the prior art is composed of an outer tube frame 11, an outer tube wall piece 13, an inner tube 16, a connection rod 17, and a retaining member 18. The outer tube frame 11 has an inverted U-shaped cross section and an open face which is provided respectively in two sides thereof with a curved insertion edge 12. The outer tube wall piece 13 is provided along the direction of a longitudinal axis thereof with a plurality of round holes 14 and is further provided respectively in two side edges thereof with an insertion slot 15, which is engaged with the insertion edge 12 of the outer tube frame 11. The inner tube 16 is disposed in an outer tube formed of the outer tube frame 11 and the outer tube wall piece 13. The connection rod 17 is received in the inner tube 16. The retaining member 18 is disposed at the bottom end of the inner tube 16 and is connected with the bottom end of the connection rod 17. When the connection rod 17 is exerted on by an external force, the retaining projection 19 is actuated to move outward to engage the round holes 14 so as to retain the inner tube 16 in such a manner that the inner tube 16 is expanded for a predetermined length.

Such a prior art expandable rod 10 as described above is defective in design in that the outer tube frame 11 and the outer tube wall piece 13 must be made separately by extrusion, and that the outer tube wall piece 13 is then provided with the round holes 14 by punching, and further that the outer tube frame 11 and the outer tube wall piece 13 are fastened together by punching. It is therefore readily apparent that the prior art expandable rod 10 is not cost-effective.

SUMMARY OF THE INVENTION

The primary objective of the present invention is therefore to provide a stepless expandable rod which is cost-effective and free from the drawbacks of the prior art expandable rod.

In keeping with the principle of the present invention, the foregoing objective of the present invention is attained by a stepless expandable rod consisting of an outer tube, an insertion strip, an inner tube, a connection rod, and a retaining member. The outer tube is provided in the inner wall thereof with two protuberances extending along the direction of the longitudinal axis of the outer tube such that the interior of the outer tube is divided into an insertion slot and a tube compartment which is greater in cross-sectional area than the insertion slot. The insertion strip is provided along the direction of a longitudinal axis thereof with a plurality of retaining holes which are arranged side by side. The insertion strip is lodged in the insertion slot of the outer tube. The inner tube is received in the tube compartment of the outer tube such that the inner tube can be extracted or retracted via the top end of the outer tube. The connection rod is received in the inner tube such that the top end of the connection rod is connected with an external control mechanism. The retaining member is fastened with the bottom end of the inner tube and is connected with the bottom end of the connection rod. The retaining member has a retaining projection capable of being actuated by the connection rod to engage one of the retaining holes so as to retain the bottom end of the inner tube at a position in the outer tube.

The foregoing objective, features and functions of the present invention will be more readily understood upon a thoughtful deliberation of the following detailed description of a preferred embodiment of the present invention with reference to the accompanying drawings.

DETAILED DESCRIPTION OF THE INVENTION

Figure 1:
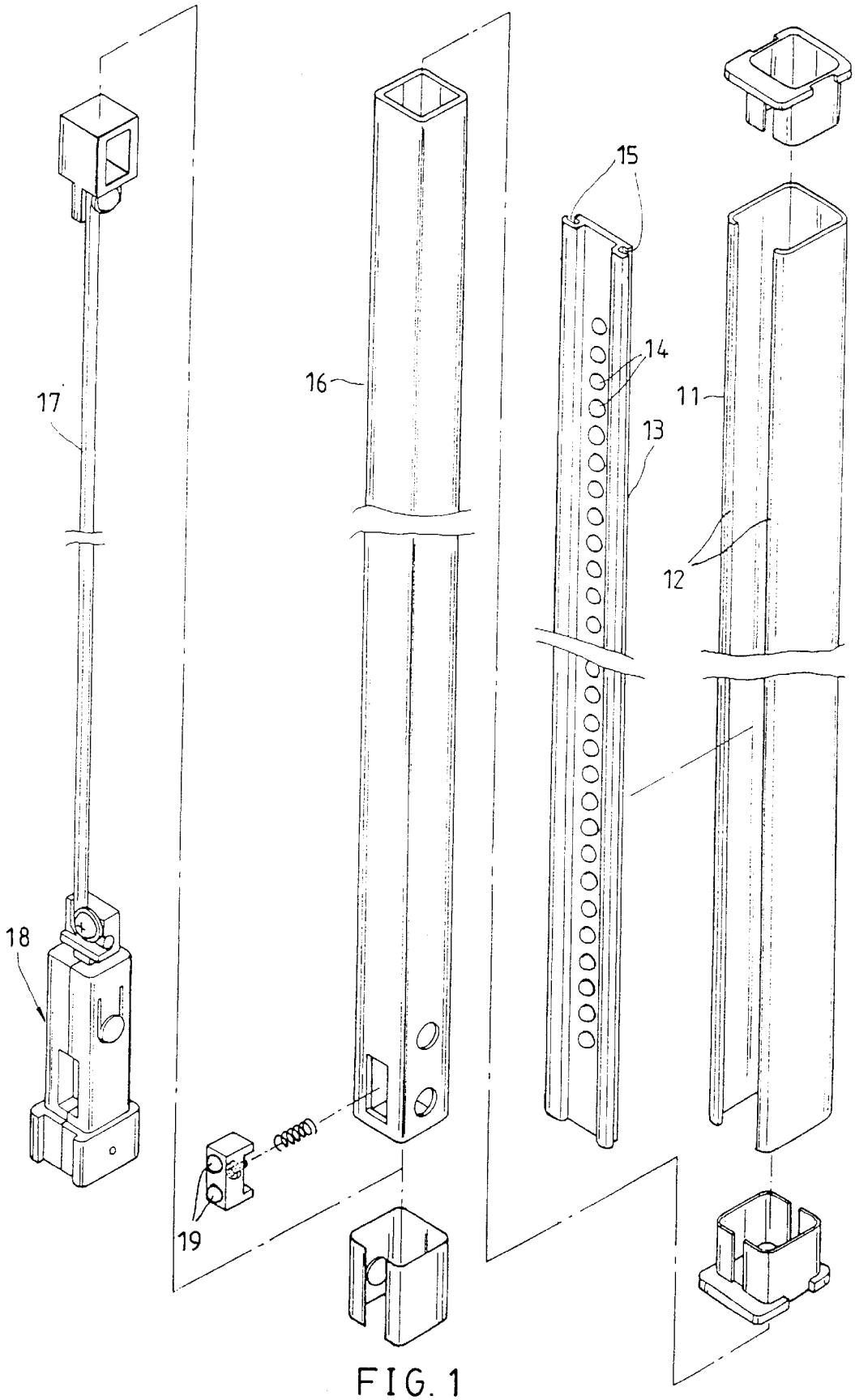
FIG. 1 shows an exploded view of an expandable rod of the prior art.
Figure 2:
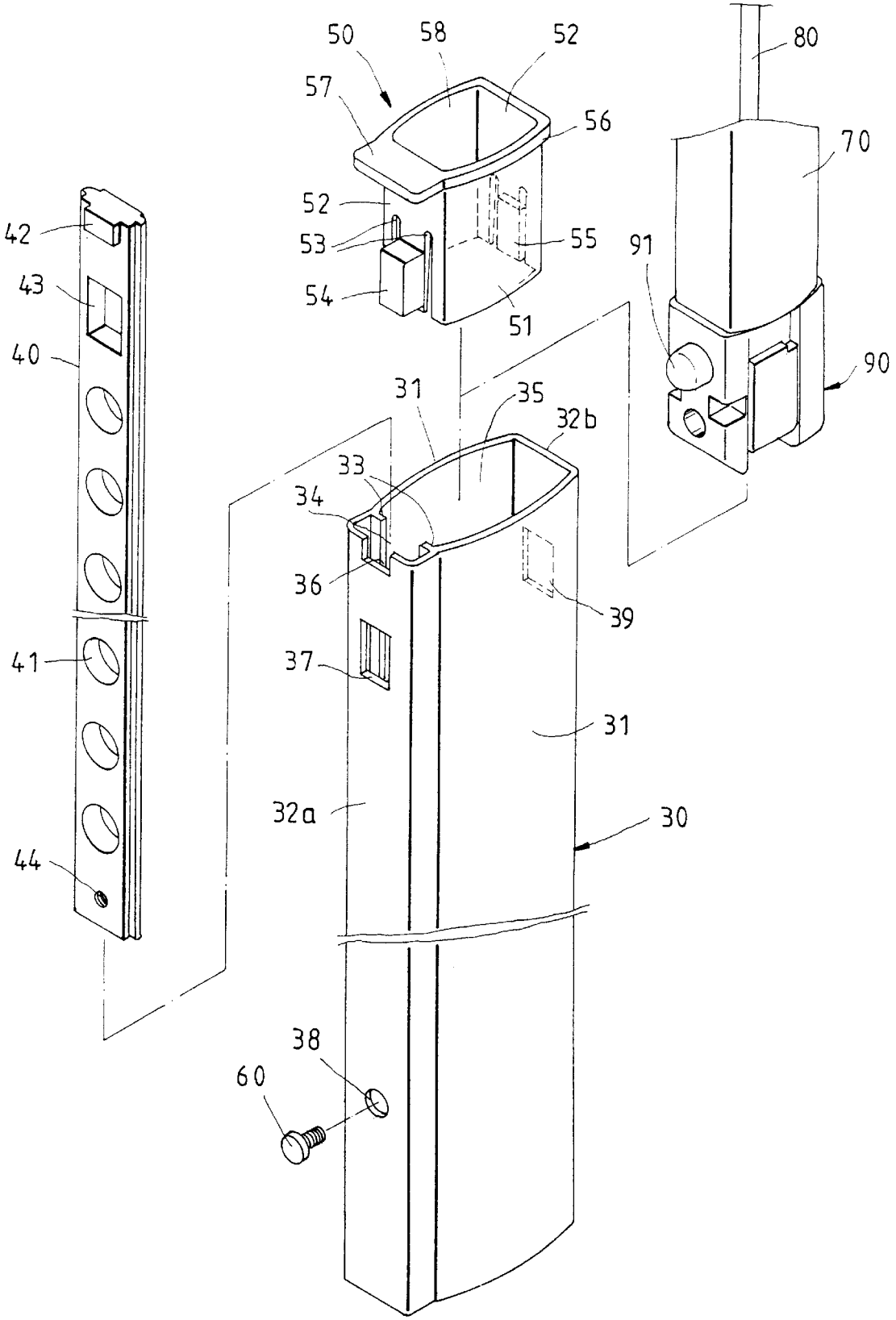
FIG. 2 shows an exploded view of an expandable rod of the present invention.
Figure 3:
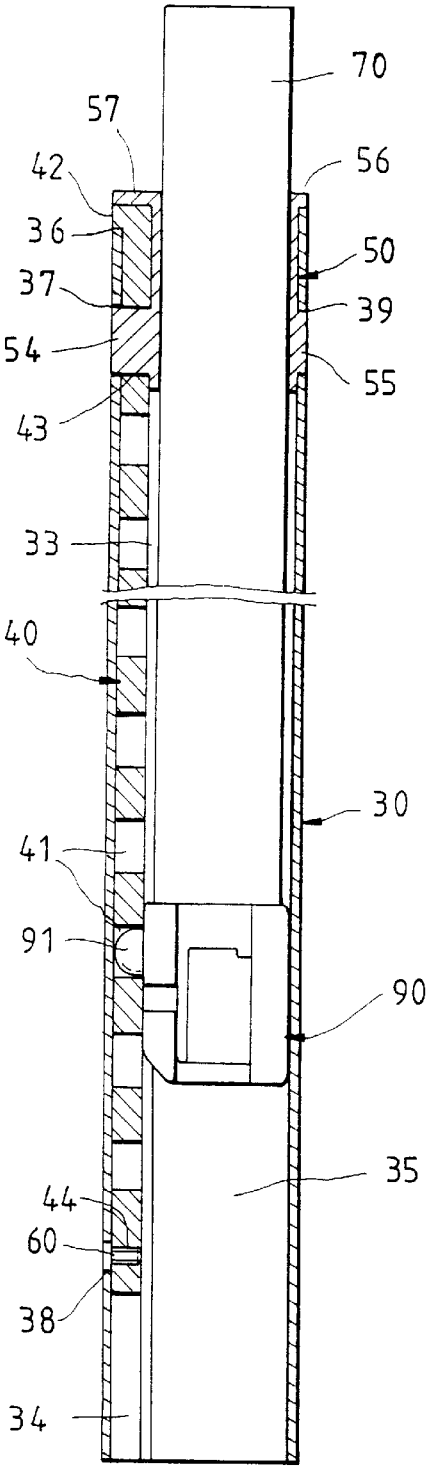
FIG. 3 shows a sectional view of the expandable rod of the present invention combination.
Figure 4:
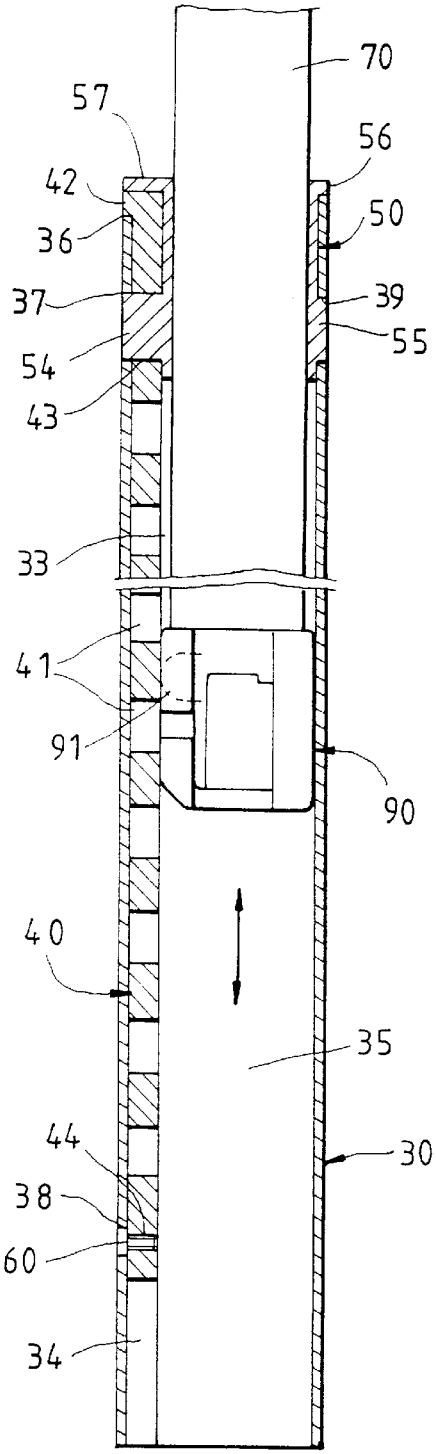
FIG. 4 shows another sectional view of the expandable rod of the present invention in combination.

As shown in FIGS. 2–4, an expandable rod 20 embodied in the present invention is composed of the component parts which are described explicitly hereinafter.

An outer tube 30 is made by extrusion and has a rectangular cross section. The outer tube 30 has two long side tube walls 31 which are provided respectively with a protuberance 33 contiguous to a short side tube wall 32*a* and extending along the direction of the longitudinal axis of the outer tube 30. The interior of the outer tube 30 is thus divided by the protuberance 33 into an insertion slot 34 and a tube compartment 35 which is greater in the cross-sectional area than the insertion slot 34. The outer tube 30 is further provided with a recessed portion 36 corresponding in location to the short side tube wall 32*a*, a rectangular fastening hole 37 located under the recessed portion 36, and a round through hole 38. Another short side tube wall 32*b* is provided with a rectangular retaining hole 39 corresponding in location to the rectangular fastening hole 37.

An insertion strip 40 is made of a plastic material by injection molding and provided along the direction of a longitudinal axis thereof with a plurality of round retaining holes 41 which are arranged equidistantly. The insertion strip 40 is further provided at a top end thereof with a protruded portion 42 and a rectangular insertion hole 43. The insertion strip 40 is still further provided at the bottom thereof with a round through hole 44. The insertion strip 40 is disposed in the insertion slot 34 of the outer tube 30 such that the protruded portion 42 is retained in the recessed portion 36 of the outer tube 30, and that the insertion hole 43 and the through hole 44 are respectively opposite to the fastening hole 37 and the through hole 38.

A tubular member 50 has a rectangular body 51 which has two short sides 52*a* and 52*b*, which are provided respectively with two grooves 53. The short side 52*a* is provided with a thick protruded block 54 located between the two grooves 53. The short side 52*b* is provided with a flat protruded block 55 located between the two grooves 53. The rectangular body 51 is provided at a top edge thereof with a lip 56, and a cover plate 57 corresponding in location to the side edge of the thick protruded block 54. The body 51 is inserted into the top end of the tube compartment 35 of the outer tube 30 such that the lip 56 is retained at the top edge of the outer tube 30, and that the cover plate 57 covers the insertion slot 34, and further that the thick protruded block 54 is retained in the fastening hole 37 of the outer tube 30 via the insertion hole 43 of the insertion strip 40, and still further that the flat protruded block 55 is retained in the retaining hole 39 of the outer tube 30.

A fastening member 60 is a screw, which is engaged with the through hole 44 of the insertion strip 40 via the through hole 38 of the outer tube 30 for fastening securely the bottom end of the insertion strip 40. The fastening member 60 may be a pin.

An inner tube 70 has a rectangular cross section and is slightly smaller than the tube compartment 35 of the outer tube 30. The inner tube 70 is received in the tube compartment 35 of the outer tube 30 via the tube hole 58 of the tubular member 50. The inner tube 70 can be extracted and retracted from the top end of the outer tube 30.

A connection rod 80 is received in the inner tube 70 and is connected at a top end thereof with an external control mechanism 80 such that the connection rod 80 can be controlled to displace axially. For example, the inner tube of an expandable rod for a luggage pull rod is connected at the top end thereof with a hand grip which is provided therein with the control mechanism.

A retaining member 90 is disposed at the bottom end of the inner tube 70 and is connected with the bottom end of the connection rod 80. The retaining member 90 has a retaining projection 91, which remains extracted under the normal condition. When the connection rod 80 is pulled upward, the retaining projection 91 is actuated to retract. The retaining member 90 is a prior art structure and is not a feature of the present invention.

The retaining projection 91 of the retaining member 90 can be extracted to engage one of the retaining holes 41 of the insertion strip 40 such that the bottom end of the inner tube 70 is retained at a predetermined position in the outer tube 30, as shown in FIG. 3. When the connection rod 80 is lifted by the external control mechanism 80, the retaining projection 91 of the retaining member 90 is retracted so as to enable the inner tube 70 to be extracted and retracted freely, as illustrated in FIG. 4. As the control mechanism is relieved of an external force exerting thereon, the retaining projection 91 is once again extracted to engage one of the retaining holes 41 so as to locate the inner tube 70 at a position where the inner tube 70 is expanded out of the outer tube 30 for a desired length.

The outer tube 30 and the insertion strip 40 are respectively made by extrusion and injection molding. The insertion strip 40 is lodged in the insertion slot 34 of the outer tube 30 and is then fastened with a fastening member 60. The processes of making the outer tube 30 and the insertion strip 40 of the present invention are simplified to an extent that the production cost of the present invention is substantially reduced as compared with the prior art.

What is claimed is:

1. A stepless expandable rod comprising:

an outer tube provided in an inner wall thereof with two protuberances of a length and extending along the direction of a longitudinal axis of said outer tube, said outer tube having an interior which is divided by said protuberances into an insertion slot and a tube compartment greater in cross-sectional area than said insertion slot;

an insertion strip provided along the direction of a longitudinal axis thereof with a plurality of retaining holes parallel to one another, said insertion strip being securely lodged in said insertion slot of said outer tube;

an inner tube received in said tube compartment of said outer tube such that said inner tube can be extracted and retracted from a top end of said outer tube;

a connection rod received in said inner tube such that a top end of said connection rod is connected with an external control mechanism, and that said connection rod can be controlled by the external control mechanism to displace along the direction of a longitudinal axis of said inner tube;

a retaining member fastened with a bottom end of said inner tube and connected with a bottom end of said connection rod, said retaining member having a retaining projection capable of being actuated by said connection rod to extract toward one side of said insertion strip to engage one of said retaining holes of said insertion strip so as to cause a bottom end of said inner tube to be retained at a position in said outer tube, said retaining projection further capable of being actuated by said connection rod to retract in a direction away from said one side of said insertion strip; and wherein a first short side tube wall of said outer tube is provided at a top end thereof with a fastening hole, and at a bottom end thereof with a through hole, said first short side tube wall corresponding in location to one side of said insertion slot of said outer tube, said outer tube having a second short side tube wall which is provided with a retaining hole corresponding in location to said fastening hole; wherein said insertion strip has an insertion hole opposite to said fastening hole, and a through hole opposite to said through hole of said first short side tube wall of said outer tube; wherein a tubular member has a rectangular body which is provided respectively in two opposite sides thereof with two grooves, with one of said two sides being provided with a thick protruded block located between said two grooves, and with another one of said two sides being provided with a flat protruded block located between said two grooves, said rectangular body further provided at a top edge thereof with a lip, and a cover plate corresponding in location to a side edge of said thick protruded block, said rectangular body being inserted into a top end of said tube compartment such that said lip is retained at a top edge of said outer tube, and that said cover plate covers said insertion slot, and further that said thick protruded block is retained in said fastening hole of said outer tube via said insertion hole of said insertion strip, and still further that said flat protruded block is retained in said retaining hole of said outer tube; and wherein said outer tube and said insertion strip are fastened securely with each other by a fastening member which is inserted into said through hole of said outer tube and said through hole of said insertion strip.

2. The stepless expandable rod as defined in claim 1, wherein said outer tube has a rectangular cross section; and wherein said two protuberances of said outer tube are located in two long side tube walls of said outer tube such that said two protuberances are contiguous to a said short side tube wall of said outer tube.

3. The stepless expandable rod as defined in claim 1, wherein said outer tube is provided with a recessed portion corresponding in location to a top edge of said short side tube wall corresponding to said one side of said insertion slot; and wherein said insertion strip is provided at a top end thereof with a protruded portion which is retained in said recessed portion.

* * * * *